US005820251A

United States Patent [19]

Greenberg et al.

[11] Patent Number: 5,820,251

[45] Date of Patent: Oct. 13, 1998

[54] ILLUMINATED ORNAMENTAL DEVICE HAVING A PLANER SURFACE AND REFLECTIVE ELEMENTS

[76] Inventors: Michael J. Greenberg; Robert M. Greenberg, both of 1633 Brighton Ct., Northbrook, Ill. 60062

[21] Appl. No.: 692,193

[22] Filed: Aug. 5, 1996

[51] Int. Cl.[6] ..... F21M 33/00; F21S 33/00; F21P 1/00

[52] U.S. Cl. ..... 362/227; 362/252; 362/806; 362/807; 362/808; 362/810; 362/812

[58] Field of Search ..... 362/103, 227, 362/800, 806, 807, 812, 808, 252, 810

[56] References Cited

U.S. PATENT DOCUMENTS

| | | | |
|---|---|---|---|
| 3,731,081 | 5/1973 | Yellin | 362/806 |
| 4,164,008 | 8/1979 | Miller et al. | 362/806 |
| 4,657,800 | 4/1987 | Long | 362/806 |
| 4,823,240 | 4/1989 | Shenker | 362/806 |
| 5,113,325 | 5/1992 | Eisenbraun | 362/806 |
| 5,278,734 | 1/1994 | Ferber | 362/800 |
| 5,366,780 | 11/1994 | Rapisarda | 362/806 |
| 5,379,202 | 1/1995 | Daun | 362/808 |
| 5,455,749 | 10/1995 | Ferber | 362/806 |
| 5,477,437 | 12/1995 | Lach | 362/806 |
| 5,519,595 | 5/1996 | Wang | 362/808 |
| 5,534,315 | 7/1996 | Witte | 362/808 |
| 5,624,181 | 4/1997 | Miller et al. | 362/103 |

*Primary Examiner*—Sandra L. O'Shea
*Assistant Examiner*—Matthew J. Spark
*Attorney, Agent, or Firm*—Gordon N. McGrew

[57] ABSTRACT

A self-illuminated, decorative ornamental device intended for indoor or outdoor residential use is suitable for day and night viewing. The device includes a planer surface having a two-dimensional color graphic image, and a multiplicity of electric lamps which are arranged on the surface to define a pattern which corresponds to the color graphic image. The color graphic image may include reflective elements to reflect light from the electric lamps.

3 Claims, 1 Drawing Sheet

ILLUMINATED ORNAMENTAL DEVICE HAVING A PLANER SURFACE AND REFLECTIVE ELEMENTS

BACKGROUND OF THE INVENTION

The present invention relates to ornamental devices. More specifically, the present invention relates to lighted, two-dimensional ornamental devices intended for both day and night display as holiday, sports, school and other decorations, especially in outdoor locations.

Ornamental decorations are often displayed in and around homes, especially during holiday seasons. Lighted decorations are particularly popular during winter holidays due to the long hours of darkness at that time of year. The use of strings of lights which are attached trees, bushes and houses is one example. While such decorations can be breathtaking at night, they have no ornamental value during daylight hours. Other types of lighted holiday decorations include real or artificial (electric) candles in windows, and lighted, carved pumpkins.

Decorations for daylight hours are also known. Three-dimensional displays of secular and religious figures or scenes are often used. School flags and pennants are another example. Recently, the use of holiday flags having various designs has become popular. While festive during the day, these decorations cannot be seen at night without an external light source, such as a spotlight.

All of these decorations suffer from various drawbacks which are specific to each type. They may be difficult and time consuming to assemble, set up and take down. They may be expensive to manufacture in large or small scale production. They may consume a large amount of electric power. They may pose a fire hazard due to the presence of an open flame. They may be space consuming when stored in the off season. And they may not have a continuity of decorative appeal during both day and night display.

There is a need for a decorative ornamental device which will overcome these deficiencies.

SUMMARY OF THE INVENTION

The present invention provides a self-illuminated, decorative ornamental device which provides common design elements for both day and night viewing. The device includes a planer surface having a two-dimensional color graphic image, and a multiplicity of electric lamps which are arranged on the surface to define a pattern which corresponds to the color graphic image.

In an embodiment, the electric lamps project forward through openings in the planer surface. Preferably, the lamps protrude forward of a plane defined by the planer surface.

In an embodiment, the color graphic image comprises reflective elements such as mirrors, reflective foil or glitter which are attached to, and positioned on the planer surface to reflect light from the electric lamps. In an embodiment, the reflective element includes an underlying layer of reflective foil and an overlying layer of reflective foil. The overlying layer is shaped and positioned to partially expose the underlying layer.

In an embodiment, the electric lamps have colors corresponding to colors in the color graphic image.

In an embodiment, the color graphic image is a holiday image.

In an embodiment, the color graphic image is a religious image.

In an embodiment, the color graphic image is a school image.

In an embodiment, the color graphic image is a sports team image.

In an embodiment, the color graphic image is a text image.

In an embodiment, the electric lamps are low wattage incandescent lamps.

An advantage of the present invention is that it provides an attractive decoration displaying corresponding, but differently rendered images for day and night viewing. That is, the same subject matter is rendered as a color graphic image for day viewing, and as a pattern of lights for viewing at night.

Another advantage of the present invention is that it is quick and easy to set up and take down.

Another advantage of the present invention is that it is inexpensive to manufacture in large or small scale production.

Another advantage of the present invention is that it consumes little electric energy.

Yet another advantage of the present invention is that it poses little risk of fire.

Yet another advantage of the present invention is that it requires little storage space.

Additional features and advantages of the present invention are described in, and will be apparent from, the detailed description of the presently preferred embodiments.

DETAILED DESCRIPTION AND PREFERRED EMBODIMENTS OF THE INVENTION

The inventors have invented a new type of ornamental device which provides a pleasing image for viewers during both day and night viewing. As used herein, the term "ornamental device" refers to non-commercial decorations which are commonly used to decorate the interior and exterior of residential structures for such purposes as celebrating holiday seasons, demonstrating support for schools and sports teams and the like.

Figure 3:
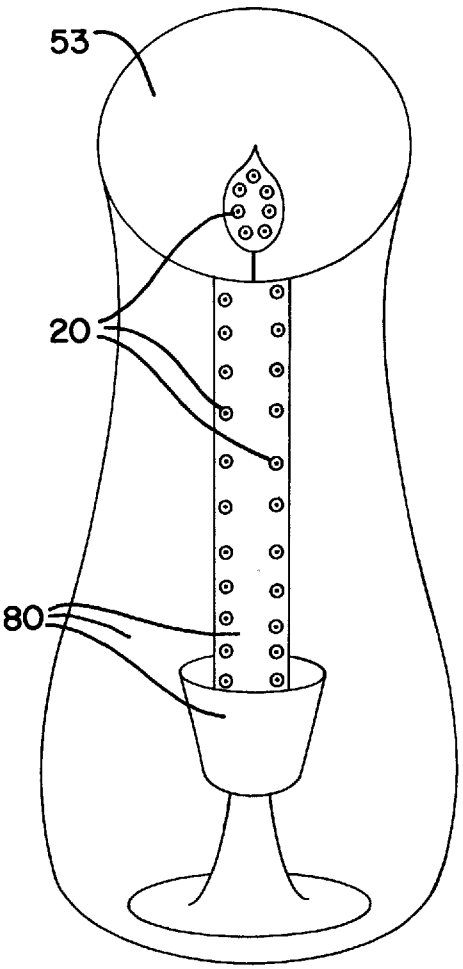
FIG. 3 illustrates a frontal view of another embodiment of the present invention.
Figure 2:
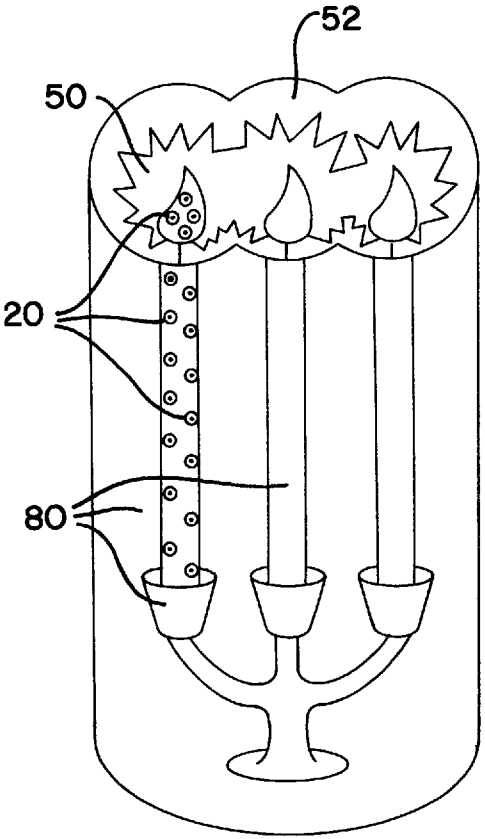
FIG. 2 illustrates a frontal view of an embodiment of the ornamental device of the present invention.
Figure 1:
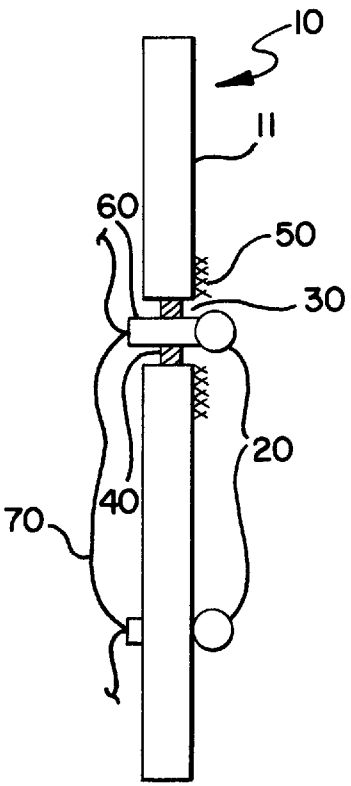
FIG. 1 illustrates a cross section, cut-away view of an embodiment of the ornamental device of the present invention.

Referring now to FIGS. 1 and 2, an embodiment of the present invention is illustrated. The ornamental device 10 comprises a planer surface 11 which carries a color graphic image 80. A multiplicity of electric lamps 20 are arranged on the planer surface 11 to define a pattern which corresponds to the color graphic image 80. Openings or apertures 30 in the planer surface allow the electric lamps 20 to project forward of the plane defined by the planer surface 11. Reflective elements 50 such as foils and 52 may be positioned on the planer surface 11 to reflect light from the electric lamps 20. The reflective elements may include a mirror 53 or a layer of overlying reflective foil 50 which is shaped and positioned to expose an underlying layer of reflective foil 52 having a different color from the overlying layer. Each lamp 20 is fitted into a lamp holder 60 which is secured into the opening 30 by means of adhesive or a friction fitting grommet 40 and is electrically connected to the circuit by wiring 70. The wiring may be attached to the back (non-viewed) side of the planer surface by means of tape, adhesive, staples or clips (not shown).

The planer surface may be the surface of a wooden board or a stiff sheet formed, for example, from plastic. The planer surface may have a relatively complex two dimensional shape which conforms to the color graphic image or it may have a simple geometric shape which serves as a frame for a more complex color graphic image. The color graphic image may be painted onto the planer surface or applied as an adhesive decal. If the planer surface is a molded plastic sheet, the color graphic image may be molded into the sheet itself. In the event that the desired image is a simple geometric shape, for example a Star of David or a Crucifix, the color graphic image may consist of a single color on the planer surface which is itself formed into the desired geometric shape.

The color graphic image may also include reflective elements such as mirrors, reflective foil, or glitter. The reflective elements are positioned to reflect the light from the electric lamps and enhance the pattern created by the electric lamps. They may also reflect natural light to enhance the color graphic image during daytime viewing. A preferred arrangement is to use two or more layers of differently colored reflective foil, the overlying layer or layers being shaped or positioned or cut away to expose the underlying layer or layers.

The electric lamps will preferably be small, low wattage incandescent lamps of the type normally sold in strings for use in holiday decorating. Preferably, each lamp will draw no more than 0.5 watt allowing even relatively large numbers of lamps to be used while keeping total energy consumption at a minimum. The use of a large number of lamps allows better definition of the lighted pattern image. The smaller lamps also allow increased definition while keeping the size of the overall display at practical dimensions, say no more than twenty square feet. The lamps may be tinted with colors which correspond to, or complement, the image.

While the lamps may be mounted on the front (viewed) side, it is strongly preferred that the lamps project forward through openings which are drilled, cut or molded into the planer surface. In this case, it is best to keep the openings as small as possible to maximize area available for the color graphic image. It may be desirable, particularly when the lamp is used in conjunction with a reflective element, for the lamp to protrude forward of the plane defined by the planer surface. However, in other applications it may be desirable for the lamp to be mounted flush with, or even recessed behind, the plane to better define a point in the pattern. The lamps are preferably mounted in lamp holders which are, in turn, mounted in the openings in, or on the surface of, the planer surface. The mounting may be by use of adhesive, clips, grommets, fasteners or any other suitable means. Of course suitable wiring will be needed to wire each lamp into a series or parallel circuit. When the lamps are mounted through openings in the planer surface, the wiring will be located on the back of the planer surface where it is hidden from view. The wiring may be attached to the back of the device by any suitable means including adhesive, clips, staples or fasteners.

EXAMPLE 1

An ornamental device of the present invention was assembled as follows. A sheet of quarter inch plywood, 24 by 42 inches, was used to form the planer surface. To form the color graphic image, the surface was first painted royal blue. A sheet of gold foil was cut into the shape of a Menorah and attached to the blue painted surface. Red and gold glitter was glued to the blue surface to form the flames of the Menorah. To complete the color graphic image, the outline of the Menorah was enhanced with blue glitter glued to the surrounding blue paint.

To form the lighted pattern image, 200 holes were drilled through the foil or glitter and the underlying painted plywood at points which would define the pattern. Four 50 lamp strings (200 lamps total) of low wattage Noma Expressions 50 holiday lights were used to form the lighted pattern. Of these, twenty-four lamps were colored red to be used to form the flames of the Menorah. The remaining lamps were white (clear) and were used to form the body of the Menorah. The lamps were inserted through the back and held in place with glue. The lamps were positioned so than the base of the bulb was flush with the surface of the device. The wires were secured to the back of the plywood with staples.

The ornamental device presented a pleasing appearance for both day and night viewing.

We claim:

1. An ornamental device comprising a planer surface, a multiplicity of electric lamps and a reflective element; said planer surface comprising a color graphic image, said multiplicity of electric lamps being arranged on the planer surface to define a pattern which corresponds to said color graphic image, and said electric lamps projecting through openings in said planer surface and protruding forward of the plane of said planer surface, and said reflective element comprising reflective foil positioned to reflect light from said electric lamps.

2. The ornamental device of claim 1 wherein said reflective element includes at least an underlying layer of reflective foil and an overlying layer of reflective foil, said overlying layer being shaped and positioned to partially expose said underlying layer.

3. An ornamental device comprising a planer surface, a multiplicity of electric lamps and a reflective element; said planer surface comprising a color graphic image, said multiplicity of electric lamps being arranged on the planer surface to define a pattern which corresponds to said color graphic image, and said electric lamps projecting through openings in said planer surface and protruding forward of the plane of said planer surface, and said reflective element comprising a mirror positioned to reflect light from said electric lamps.

* * * * *